US005189740A

United States Patent [19]

Diethelm

[11] Patent Number: 5,189,740

[45] Date of Patent: Mar. 2, 1993

[54] TOILET SEAT ASSEMBLY WITH A BIDET

[75] Inventor: Alois Diethelm, Tuggen, Switzerland

[73] Assignee: Geberit AG, Jona, Switzerland

[21] Appl. No.: 679,643

[22] Filed: Apr. 2, 1991

[30] Foreign Application Priority Data

Apr. 3, 1990 [CH] Switzerland ..... 1110/90

[51] Int. Cl.[5] ..... A47K 3/20

[52] U.S. Cl. ..... 4/420.4

[58] Field of Search ..... 4/420.1, 420.2, 420.3, 4/420.4, 420.5, 443, 444, 445, 446, 447, 448

[56] References Cited

U.S. PATENT DOCUMENTS 3,247,524 1/1964 Umann ..... 4/420.2
4,173,802 11/1979 Wikstrom ..... 4/236
4,197,596 4/1980 Fantetti ..... 4/236
4,817,215 4/1989 Stewart ..... 4/236

*Primary Examiner*—Charles E. Phillips
*Attorney, Agent, or Firm*—McGlew and Tuttle

[57] ABSTRACT

A toilet seat assembly is provided with a toilet seat (1) as well as a toilet lid (8), which can be separated for cleaning from each other and from a bidet (42) arranged in a hollow projection of the toilet seat (1) by simple manipulations and without tools. Flank parts (38, 39), which are pivotably mounted on the housing (17) of the bidet with support pins (12, 13) made in one piece on the inside of the housing, are made in one piece with the toilet seat assembly (1). Actuating members, which cooperate with an elastic tongue (25) or with a disk (21) of the bidet (42) to actuate a pressure switch (27) or a valve (28), are also arranged in these flank parts. The housing (17) of the bidet (42) is closed practically completely and is protected from splashing water even when the toilet seat has been removed.

10 Claims, 2 Drawing Sheets

TOILET SEAT ASSEMBLY WITH A BIDET

FIELD OF THE INVENTION

The present invention pertains to a toilet seat assembly with a bidet arranged in a hollow projection of a toilet seat, wherein the toilet seat is pivotably mounted on a tubular housing of the bidet.

BACKGROUND OF THE INVENTION

A toilet seat assembly of this type is manufactured by the Applicant. It has the advantage that it can be installed on practically all commercially available toilets, so that it can be installed with little effort even on existing toilets. The housing of the bidet consists of a tubular part, in which the individual components of the bidet are inserted, and which is closed with a disk screwed on. The hollow projection of the toilet seat surrounds the tubular housing part and is pivotably mounted on it, so that it can be pivoted upward through about 90° from its horizontal use position. To separate the toilet seat from the bidet for a thorough cleaning of the toilet seat assembly, it is necessary to screw off the cover. Such removal requires trade skill and is therefore often an obstacle to frequent and regular cleaning of the toilet seat assembly, which is desirable for hygienic reasons.

SUMMARY AND OBJECTS OF THE INVENTION

It is a primary object of the present invention to provide a toilet seat assembly of the above-described class, in which the toilet seat can be removed in a simpler manner and which can nevertheless be manufactured at low cost and is reliable in operation.

According to the invention, a toilet seat assembly is provided with a bidet arranged in a hollow projection of the toilet seat. The toilet seat is pivotably mounted on a tubular housing of the bidet. The toilet seat is mounted at ends of the tubular housing such that the toilet seat can be lifted up and the tubular housing is essentially closed on all sides when the toilet seat is lifted up.

In the case of the toilet seat assembly according to the present invention, the toilet seat is mounted outside on the front sides of the housing of the bidet. The toilet seat can be lifted off from the housing of the bidet, and the housing of the bidet is essentially closed when the toilet seat has been taken off. Thus, it is essential that when the toilet seat is removed, the interior of the bidet is not exposed, so that the risk of damage to the components accommodated in the housing and the risk of electrical contact are ruled out.

In a variant of the present invention, support shells, into which support pins arranged on flank parts of the toilet seat are inserted, are arranged on the front side of the housing. Thus, a simpler design of the mounting of the toilet seat is provided, which does not require any screw connections and in which the toilet seat can be lifted off and put in place in a particularly simple manner. The flank parts of the toilet seat can also have an arrangement to receive a push-button and/or a knob to actuate a switch or to control a valve.

According to a variant of the present invention, the push-button and the knob are inserted into openings of the flank parts, which openings are coaxial with the support, in a positive-locking manner. This permits a substantially more compact design of the housing of the bidet. If transmission members, which transmit the movement of the push-button or of the knob to a switch or a valve in the housing of the bidet, are also arranged on the front side of the housing of the bidet, the housing can be designed as a practically liquid-tight housing, and reliable actuation and control of the bidet is nevertheless possible. Further advantageous characteristics will become apparent from the other dependent claims as well as the description that follows.

One embodiment of the present invention will be explained below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS In the drawings.

DETAILED DESCRIPTION OF THE PREFERRED EMBODIMENT

Figure 1:
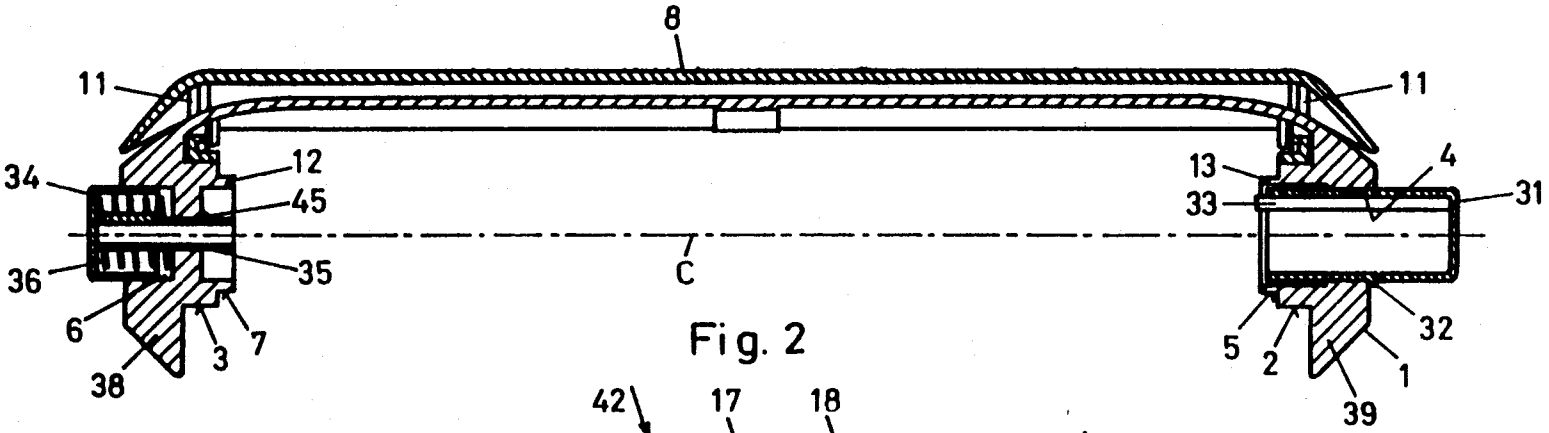
FIG. 1 is a section through a toilet seat and a mounted lid.

The bidet 42 has a tubular, essentially closed housing 17 with a bottom part 19 and a cover part 18. The bottom part 19 is fastened to a toilet bowl 14 with bolts 16 and wing nuts 15 in the known manner. Among other things, a shower arm 20, as well as a boiler for the shower water are accommodated in the housing 17. A switch 27, with which the showering process can be initiated, as well as a valve 28, with which the shower water can be controlled, are also accommodated in the housing. The housing 17 is completely sealed against splashing water with labyrinth packings that are not specifically shown here.

Figure 7:
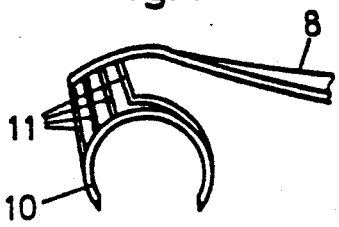
FIG. 7 is a section through part of a toilet lid.

The bidet 42 is accommodated in a hollow projection 5 of the toilet seat 1. The projection 5 has flank parts 38 and 39 made in one piece with it on the side, which have stepped support pins 12 and 13, respectively, on the inside. The support pins 12 and 13 are inserted from the top into support shells 23 and 24, respectively. As is apparent from FIG. 2, the support shells 23 and 24 are open at the top. The cylindrical support surfaces 2 and 3 are in contact with adjusted support surfaces 43 and 44 of the housing 17 when the toilet seat 1 is mounted. The support pins 12 and 13 also serve to mount a toilet lid 8 and have stepped support surfaces 2 and 3 for this purpose, on which an open support ring 10 (FIG. 7) is snapped on detachably. The support surfaces 2 and 3 are nonround, so that the support rings 10 can be mounted and lifted off again only when the lid 8 has been opened up to the rear through an angle of 120°. Since the flush tank is mounted on the toilet bowl 14 behind the seat assembly, this pivoted position cannot be reached, so that the, lid 8 can be removed from the toilet seat 1 only if the tank has been removed from the toilet bowl 14. As is apparent from FIG. 7, the support rings 10 are made in one piece with the toilet lid 8 via a plurality of webs 11. The webs 11 fasten the support rings 10 at a suitably spaced location on the underside of the lid 8.

Figure 2:
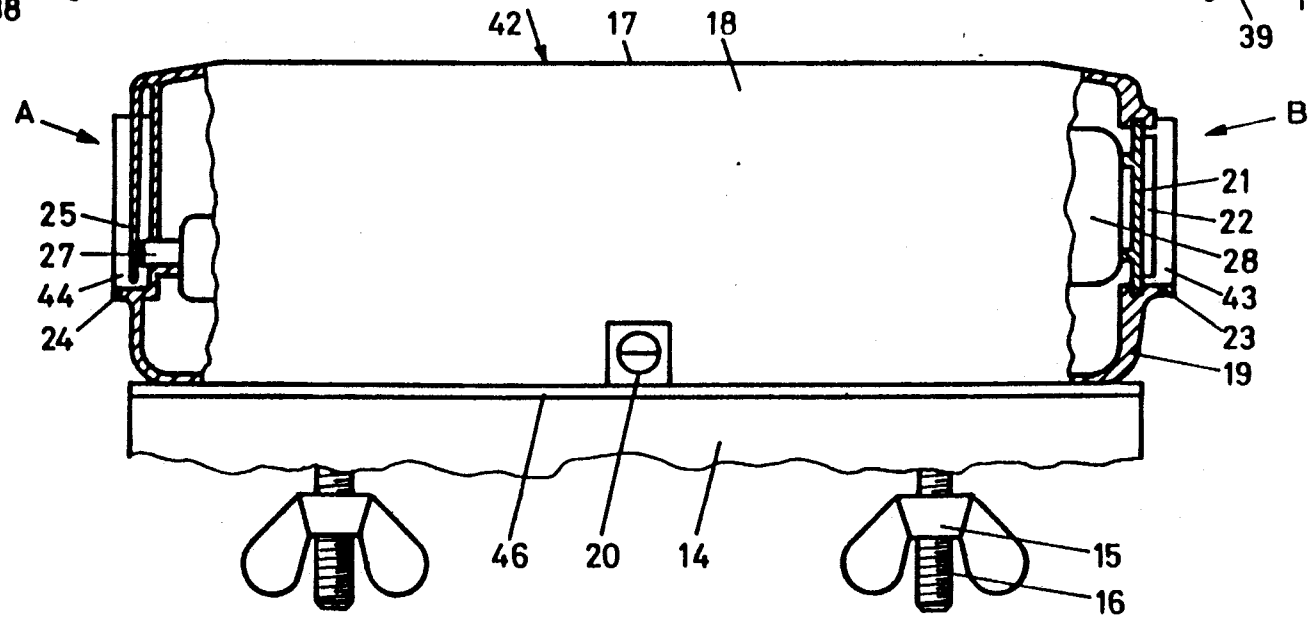
FIG. 2 is a view of part of a toilet bowl with a partially cut-away bidet.
Figure 3:
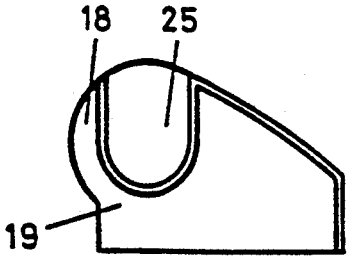
FIG. 3 is a left side elevational view of the bidet.

The flank parts 38 and 39 have openings 6 and 4, which are coaxial with the axis C of the support pins 12 and 13. A push-button 34, which can be pushed manually to the right in FIG. 1 against the restoring force of a coil spring 36, is inserted into the opening 6 from the outside, and a projection 35 pivots a tongue 25 against the switch 27 and actuates it. The tongue 25 is made in one piece with the top of the lid part 18, as is shown in FIGS. 2 and 3. When the push-button 34 is released, it is reset by the spring 36 into the position shown in FIG. 1, and the tongue 25 elastically returns into the resting position shown in FIG. 2. In order to prevent the push-button 34 from dropping out of the opening 6, a stop cam 45 is made in one piece with the projection 35.

Figure 4:
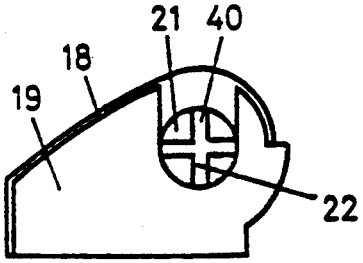
FIG. 4 is a right side elevational view of the bidet.

A knob 31, which is accessible from the outside, is inserted into the opening 4 from the inside of the flank part 39. The knob 31 also has a stop cam 32, which prevents the knob 31 from dropping out. When the toilet seat 1 is mounted on the bidet 42, an internally projecting cam 33 snaps into one of the grooves 40 of a disk 21. As is shown in FIGS. 2 and 4, the grooves 40 are formed by two crossed depressions. The disk 21 is rotatably mounted in the housing parts 18 and 19 and is connected to the valve 28 on the inside. Upon rotating the knob 31, the cam 33, which is arranged eccentrically of axis C, rotates the disk 21, which in turn will adjust the valve 28. By pulling out the knob 31 (to the right in FIG. 1), the engagement of the cam 33 with the disk 21 is abolished, after which the toilet seat 1 with the lid 8 mounted can be lifted off from the bidet 42 with ease. Thus, the toilet seat 1 can be separated from the bidet 42 without tools in a very simple manner. After mounting the toilet seat 1, the push-button 34 and the knob 31 can be engaged immediately. To check the operation of the bidet 42, the switch 27 can be actuated by means of the tongue 25 and the valve 28 using the disk 21 even if the toilet seat 1 has been removed.

Figure 5:
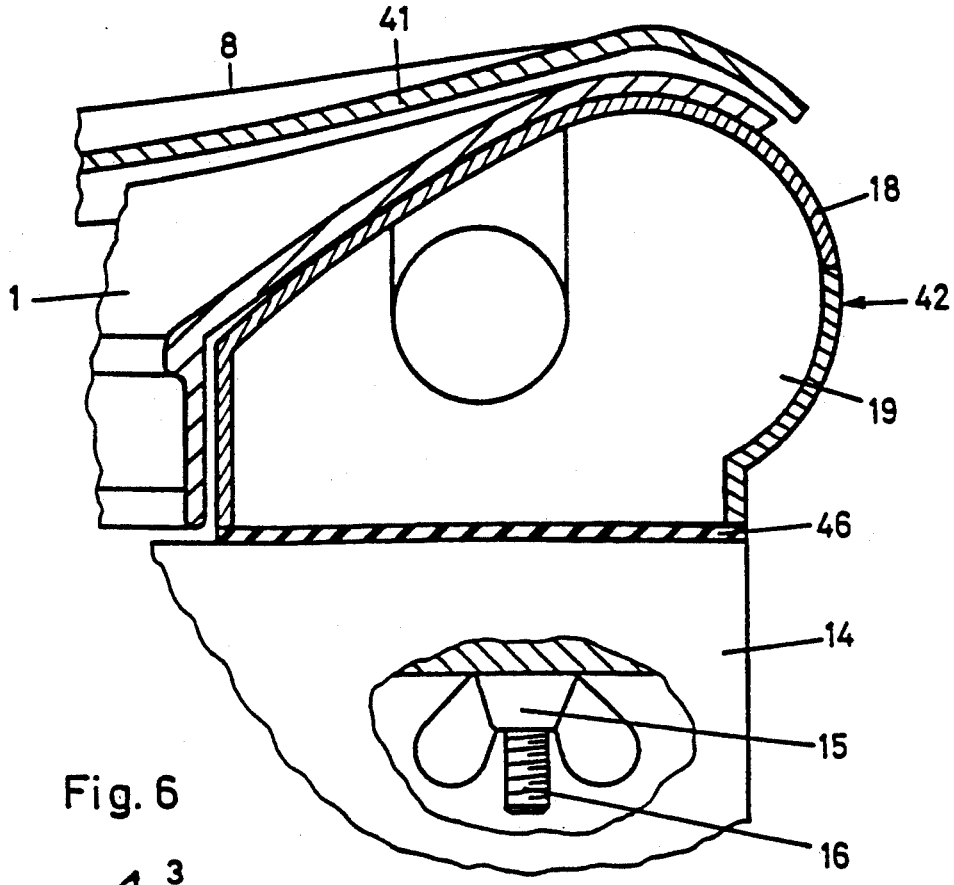
FIG. 5 is a partially cut-away partial view of a toilet assembly with a toilet seat assembly according to the present invention.
Figure 6:
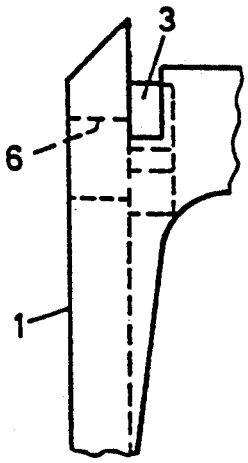
FIG. 6 is a partial view of a toilet seat.

As is apparent from FIGS. 2 and 5, a mat 46 is arranged between the bidet 42 and the toilet bowl 14. The mat 46 preferably consists of closed- cell foam and has the advantage of equalizing unevennesses of the toilet bowl 14, so that no dirt can penetrate between the toilet bowl 14 and the bidet 42.

One essential advantage of the toilet seat assembly according to the present invention is considered to be the fact that there is greater freedom in designing the shape of the toilet seat and the lid compared with the prior- art design.

While a specific embodiment of the invention has been shown and described in detail to illustrate the application of the principles of the invention, it will be understood that the invention may be embodied otherwise without departing from such principles.

What is claimed is:

1. A toilet seat assembly, comprising: a toilet seat with a hollow projection, a bidet arranged in said hollow projection of said toilet seat, said bidet having means to affix it to a toilet bowl said bidet including a tubular housing with ends for pivotably supporting said toilet seat such that said toilet seat may be lifted up, said tubular housing having a shower arm and being substantially closed on all sides to prevent exposure of the housing interior to the ambient when said toilet seat is lifted up, flank parts defining opposite sides of said hollow projection and at lest one of said flank parts arranged to house at least one of a push-button and a knob at least one of a switch and, a valve arranged in said tubular housing, said at least one push button and said knob being respectively engageable with said at least one of said switch and said valve.

2. A toilet seat assembly in accordance with claim 1, further comprising support shells arranged on opposite sides of said tubular housing and support pins arranged radially on said flank parts, said support pins being inserted into said support shells in a positive-locking manner.

3. A toilet seat assembly in accordance with claim 1, wherein said flank parts define coaxial openings said push-button and said knob are inserted into said openings.

4. A toilet seat assembly in accordance with claim 1, further comprising a member which transmits a movement of said push-button to a switch arranged in said tubular housing, arranged on a side of said tubular housing.

5. A toilet seat assembly in accordance with claim 4, wherein said member is an elastic tongue, which can e deflected by means of the push-button to actuate said switch.

6. A toilet seat assembly in accordance with claim 1, further comprising a member which transmits a movement of said knob to a valve arranged in said tubular housing, arranged on a side of said tubular housing.

7. A toilet seat assembly in accordance with claim 6, characterized in that said member is a disk mounted rotatably in the housing.

8. A toilet seat assembly in accordance with claim 7, wherein said disk has radially open and crossed grooves on an outside thereof, said knob including a cam eccentrically engaging said grooves.

9. A toilet seat assembly in accordance with claim 1 further comprising a toilet lid, said toilet lid having open support rings said toilet seat includes support surfaces arranged at spaced locations from each other, said support rings being snapped onto said support surfaces.

10. A toilet seat assembly in accordance with claim 1, wherein said housing has a cup-shaped bottom part and a cover part, and said up shaped bottom part has support parts for pivotably mounting the toilet seat.

* * * * *